US010640251B2

(12) United States Patent
Campagnoli et al.

(10) Patent No.: US 10,640,251 B2
(45) **Date of Patent: *May 5, 2020**

(54) AUTOMATIC PACKAGING MACHINE FOR FILLING A BAG MADE OF A HEAT-SEALABLE MATERIAL WITH A DOSE OF A LOOSE PRODUCT

(71) Applicant: VOLPAK, S.A.U., Santa Perpetua De Mogoda (ES)

(72) Inventors: Enrico Campagnoli, San Giovanni In Persiceto (IT); Luca Borderi, Sasso Marconi (IT); Luca Cavazza, Bologna (IT); Enrica Vassallo, Bologna (IT); Andrea Biondi, Bologna (IT); Paolo Guareschi, Parma (IT); Umberto Zanetti, Modena (IT); Fabrizio Tale, Bologna (IT)

(73) Assignee: VOLPAK, S.A.U., Santa Perpetua De Mogoda (ES)

( * ) Notice: Subject to any disclaimer, the term of this patent is extended or adjusted under 35 U.S.C. 154(b) by 240 days.

This patent is subject to a terminal disclaimer.

(21) Appl. No.: 15/622,491

(22) Filed: Jun. 14, 2017

(65) Prior Publication Data

US 2017/0361967 A1 Dec. 21, 2017

(30) Foreign Application Priority Data

Jun. 15, 2016 (EP) ..... 16174643

(51) Int. Cl.
*B65B 59/02* (2006.01)
*B65B 43/46* (2006.01)
*B65B 43/60* (2006.01)

(52) U.S. Cl.
CPC ..... *B65B 59/02* (2013.01); *B65B 43/465* (2013.01); *B65B 43/60* (2013.01)

(58) Field of Classification Search
CPC ..... B65B 43/465; B65B 43/60; B65B 59/02; B65B 43/32; B65B 43/46; B65B 43/50;
(Continued)

(56) References Cited

U.S. PATENT DOCUMENTS 3,323,280 A * 6/1967 Rausch ..... B65B 43/26 53/276
3,453,799 A * 7/1969 Cloud ..... B65B 9/087 53/385.1
(Continued)

FOREIGN PATENT DOCUMENTS

DE 34 16 567 A1 12/1985
EP 2 572 996 A1 3/2013
(Continued)

OTHER PUBLICATIONS

European Search Report for EP 16 17 4643, dated Dec. 2, 2016.

*Primary Examiner* — Andrew M Tecco
*Assistant Examiner* — Nicholas E Igbokwe
(74) *Attorney, Agent, or Firm* — Sughrue Mion, PLLC

(57) ABSTRACT

Automatic packaging machine (3) for filling a bag (1) made of heat-sealable material, having an open upper end (2) with a dose of loose product; the packaging machine (3) has: a packaging conveyor (4); a pick-up head (7), which is supported by the packaging conveyor (4) to advance along a packaging path (P1); an input station (S1) where the empty bag (1) is grabbed by the pick-up head (7); an output station (S2) where the full, sealed bag (1) leaves the pick-up head (7); a filling device (18) that is mounted on the packaging conveyor (4) to move together with the pick-up head (7) along the entire packaging path (P1) and is adapted to supply the dose of product inside the bag (1) through the upper open end (2); and a sealing device (19) that is mounted on the packaging conveyor (4) to move together with the pick-up
(Continued)

head (7) along the entire packaging path (P1) and is adapted to seal the full bag (1) through a heat-seal in correspondence with the open upper end (2).

22 Claims, 13 Drawing Sheets

(58) Field of Classification Search
CPC ..... B65B 43/54; B65B 43/56; B65B 43/62; B65B 43/28; B65B 43/30; B65B 43/59
See application file for complete search history.

(56) References Cited

U.S. PATENT DOCUMENTS 3,821,873 A * 7/1974 Benner, Jr. ..... B65B 9/087 53/437
5,222,422 A * 6/1993 Benner, Jr. ..... B26D 7/01 83/152
5,315,807 A * 5/1994 Restle ..... B26D 5/32 493/9
5,605,183 A * 2/1997 Hartman ..... B65B 43/60 141/100
6,119,440 A * 9/2000 Benner, Jr. ..... B65B 39/145 53/202
7,021,036 B2 * 4/2006 Hiramoto ..... B65B 43/04 493/186
2001/0015056 A1 * 8/2001 Hiramoto ..... B29C 65/18 53/479
2005/0229550 A1 * 10/2005 Eder ..... B65B 3/04 53/571
2007/0180794 A1 * 8/2007 Paunesku ..... B65B 9/087 53/455
2009/0056281 A1 * 3/2009 Murray ..... B65B 3/02 53/455
2010/0180550 A1 * 7/2010 Yamamoto ..... B65B 3/06 53/459
2014/0110222 A1 * 4/2014 Prieto Male ..... B65G 29/00 198/470.1
2014/0130460 A1 5/2014 Paunesku et al.
2015/0135651 A1 * 5/2015 Murray ..... B65B 43/32 53/492
2015/0274336 A1 * 10/2015 Kaneko ..... B65B 31/04 53/79
2016/0221702 A1 * 8/2016 Haddow ..... B65B 61/12
2018/0312280 A1 * 11/2018 Biondi ..... B65B 1/10

FOREIGN PATENT DOCUMENTS

EP 2 722 282 A1 4/2014
WO 2012/136869 A1 10/2012

* cited by examiner

AUTOMATIC PACKAGING MACHINE FOR FILLING A BAG MADE OF A HEAT-SEALABLE MATERIAL WITH A DOSE OF A LOOSE PRODUCT

TECHNICAL FIELD

The present invention relates to an automatic packaging machine for filling a bag made of heat-sealable material with a dose of loose product (i.e. one that does not have any cohesion, any adhesion among the parts which compose it and therefore does not have its own shape, such as a powder product, a grated product or a liquid product).

The present invention is advantageously applied in an automatic packaging machine for filling a bag of heat-sealable material with a dose of a loose food product, to which the following specification will make explicit reference without, for this reason, losing its generality.

PRIOR ART

The patent applications EP2722282A1 and WO2012136869A1 describe an automatic packaging machine for filling a bag made of heat-sealable material with a dose of a loose food product with a predetermined dose of a loose food product; this packaging machine includes a packaging conveyor which supports a number of pick-up heads that are adapted to grip and hold a corresponding bag in order to make the pick-up heads advance along a packaging path (the chain that holds the pick-up heads is wrapped around two or three sprockets to give the packaging path a complex form). The packaging path passes through, in succession, an input station in which a preformed bag, empty, open at the upper end and in a flattened configuration (i.e. with the opposite edges of the upper part in close mutual contact) is coupled to a respective pick-up head, an opening station in which each bag is opened by separating the opposite edges of the upper end, a filling station in which a predetermined dose of food product is fed from above into each bag through the open upper end, a sealing device in which the open upper end of each bag is sealed by executing a heat-sealing, and an output station in which each filled and sealed bag leaves the corresponding pick-up head.

Each pick-up head includes a pair of clamps which are opposite one another and are designed to grab opposite side ends of a corresponding bag; the two clamps of each pick-up head are movable in order to move closer to and away from each other, and so following the deformation of the bag when the same bag is opened (that is, when the opposite edges of the upper end are separated from each other).

In the filling station, through the open upper end of each bag, a filler device is inserted which feeds from above the predetermined dose of food product; the filler device also comprises one or more nozzles, which inject an inert gas into the bag (typically nitrogen) at the same time with the feeding of the food product to reduce the content of oxygen inside the bag.

In the sealing station there is a sealing clamp which squeezes the bag at the open upper end in order to apply pressure and heat and determining locally the melting, and so the sealing, of the plastic material which constitutes the bag.

DESCRIPTION OF THE INVENTION

The object of the present invention is to provide an automatic packaging machine for filling a bag made of a heat-sealable material with a dose of a loose product, and so that this automatic packaging machine makes it possible to improve the performance offered by the automatic packaging machines already known with respect to the quality of the product, the percentage of waste (i.e. of defective products), the amount of space used, and the accessibility for the execution of cleaning, maintenance and size change services.

In accordance with the present invention an automatic packaging machine for filling a bag made of a heat-sealable material with a dose of a loose product is provided, as claimed in the attached claims.

SHORT DESCRIPTION OF THE DRAWINGS

The present invention will now be described with reference to the annexed drawings, which illustrate an example of a non-limiting embodiment, in which.

PREFERRED FORMS OF EMBODIMENT OF THE INVENTION

Figure 1:
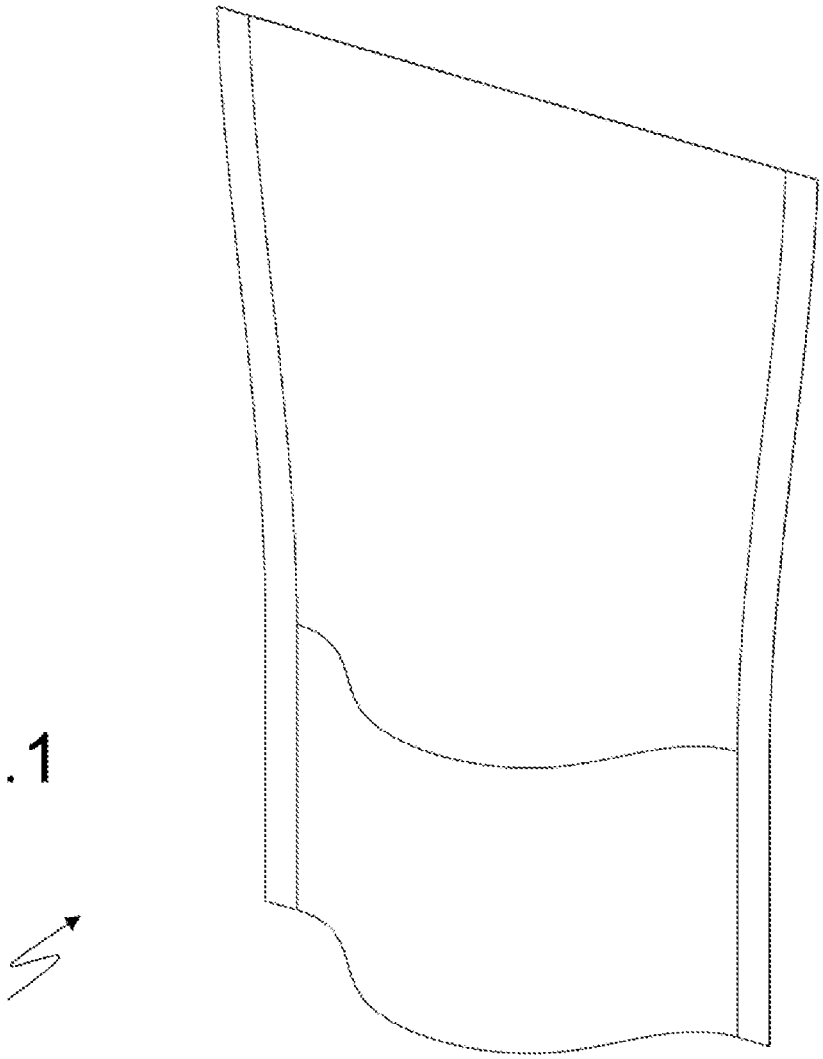
FIG. 1 is a perspective view of a bag made of heat-sealable material which contains inside a dose of a loose product.

FIG. 1 illustrates a bag made of heat-sealable material which contains inside a dose of a loose product (i.e. one that does not have any cohesion, any adhesion among the parts which compose it and therefore does not have its own shape, such as a powder product, a grated product or a liquid product). The bag 1 has an upper end 2 that is initially open for the introduction of the dose of a loose product and is subsequently sealed through a transversal sealing.

Figure 2:
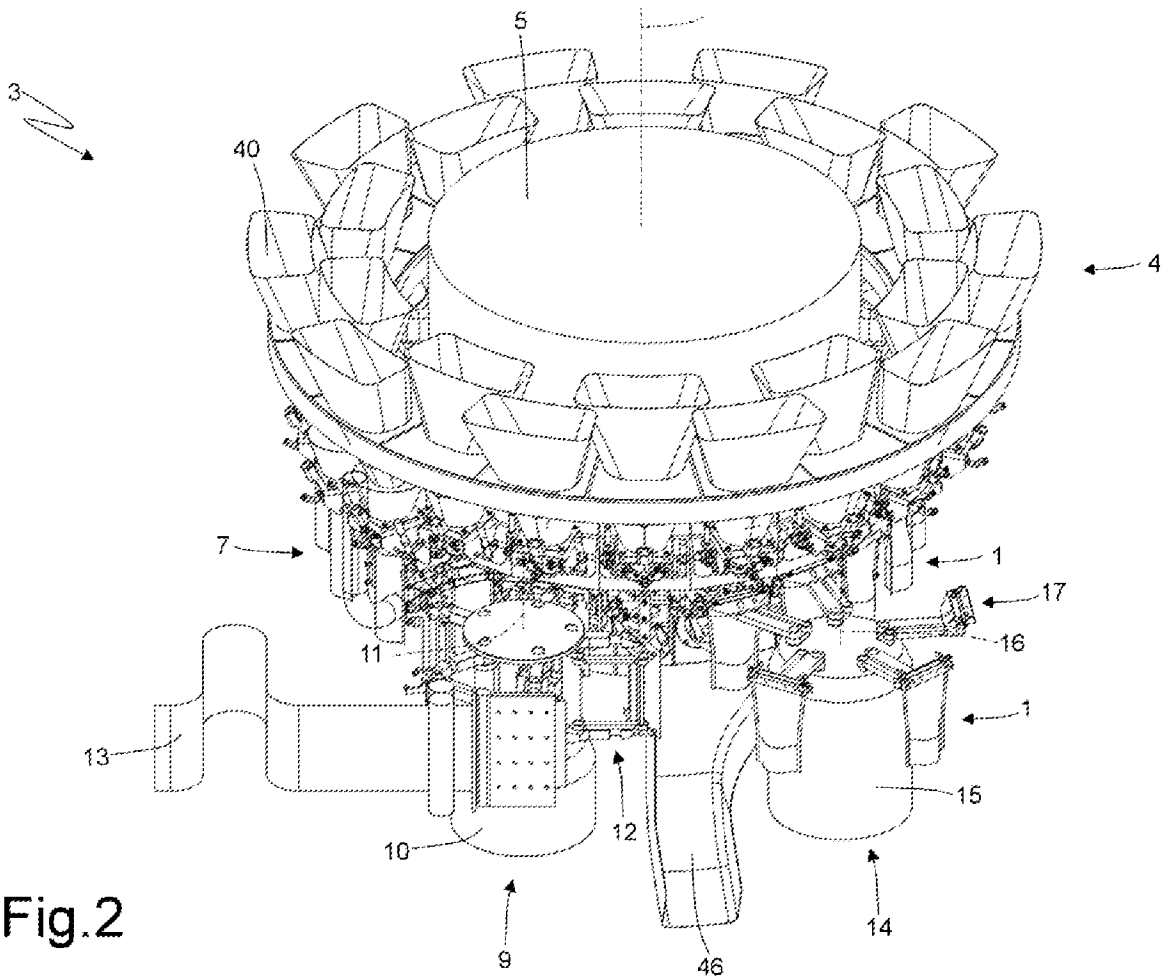
FIG. 2 is a perspective view, with some parts removed for clarity, of a packaging machine that carries out the filling and sealing of the bag of FIG. 1 and is made in accordance with the present invention.
Figure 3:
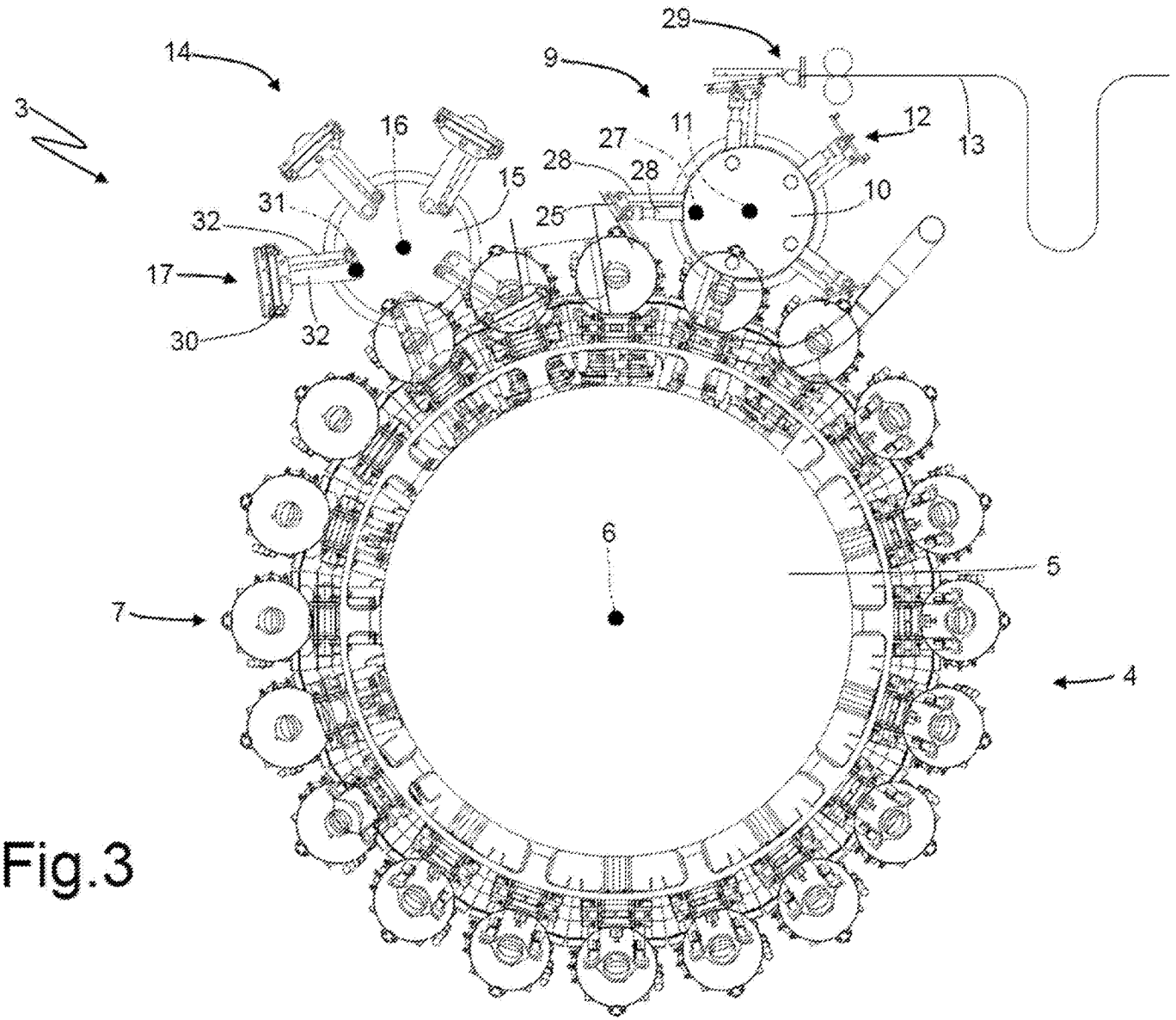
FIG. 3 is a plan view of the packaging machine of FIG. 2.

In FIGS. 2 and 3 the number 3 indicates as a whole an automatic packaging machine that carries out the filling and the sealing of the bag 1.

The packaging machine 3 includes a packaging conveyor 4 provided with a drum 5 which is disposed horizontally and rotates with a continuous motion (that is with a law of motion that has a continuous motion instead of alternating pauses and phases of motion) around a vertical rotation axis 6. The packaging conveyor 4 (i.e. the drum 5 of the packaging conveyor 4) supports many pick-up heads 7, which are arranged around the periphery of the drum 5. Each pick-up head 7 is advanced by the packaging conveyor 4 for feeding along a horizontal (i.e. lying on a horizontal plane)

and circular packaging path P1 (illustrated in FIG. 4), and it is designed to grab and hold a corresponding bag 1 along the packaging path P1. The packaging path P1 is developed between an input station S1 (arranged at the beginning of the packaging path P1) in which the bags 1, empty and open at the top, are fed in succession to the corresponding pick-up heads 7 (that is, in which each empty bag 1 is grabbed by the corresponding pick-up head 7) and an output station S2 (arranged at the end of the packaging path P1) in which the full and sealed bags are released in succession by the corresponding pick-up heads 7 (that is, in which each full and sealed bag 1 leaves the corresponding pick-up head 7). As more clearly shown in FIG. 5, each pick-up head 7 includes at least a pair of clamps 8 which are opposite one another and are designed to grab opposite side ends of the corresponding bag 1.

As shown in FIGS. 2 and 3, the packaging machine 3 includes a supplying conveyor 9, which is arranged next to the packaging conveyor 4 in correspondence with the input station S1 (shown in FIG. 4) and is provided with a drum 10 that it is disposed horizontally and rotates with continuous motion around a vertical rotation axis 11 and parallel to the rotation axis 6. The supplying conveyor 9 (that is the drum 10 of the supplying conveyor 9) supports many supplying heads 12, which are arranged around the periphery of the drum 10. Each supplying head 12 is advanced by the supplying conveyor 9 to feed along a horizontal (i.e. one that lies on a horizontal plane) and circular supplying path P2 (shown in FIG. 4) and is designed to grab and hold a corresponding bag 1 along the supplying path P2. The supplying path P2 is developed between a cutting station S3 (arranged at the beginning of the supplying path P2 and shown in FIG. 4) in which the empty and flattened bags 1 (i.e. having a flat shape in which the internal volume is substantially zeroed) are separated through a transverse cut by a continuous belt 13 of preformed bags 1 and the input station S1 (arranged at the end of the supplying path P2 and shown in FIG. 4) in which each empty bag 1, open at the upper end, is cyclically moved from a supplying head 12 of the supplying conveyor 9 to a pick-up head 7 of the packaging conveyor 4.

The packaging machine 3 includes a stabilization conveyor 14 (or cooling conveyor 14), that is arranged next to the packaging conveyor 4 in correspondence with the output station S2 (shown in FIG. 4) and is provided with a drum 15 that it is arranged horizontally and rotates with a continuous motion around a vertical rotation axis 16 and parallel to the rotation axis 6. The stabilization conveyor 14 (i.e. the drum 15 of the stabilization conveyor 14) supports many stabilization heads 17, which are arranged around the periphery of the drum 15. Each stabilization head 17 is advanced by the stabilization conveyor 14 to feed along a horizontal (i.e. one that lies on a horizontal plane) and circular stabilization path P3 (shown in FIG. 4) and is designed to grab and hold a corresponding bag 1 along stabilization path P3. The stabilization path P3 is developed between the output station S2 (arranged at the beginning of the stabilization path P3 and shown in FIG. 4) in which each full and sealed bag 1 is cyclically moved from a pick-up head 7 of the packaging conveyor 4 to a stabilization head 17 of the stabilization conveyor 14 and a transfer station S4 (shown in FIG. 4) from which each full and sealed bag 1 leaves the stabilization head 17 and continues towards an outlet of the packaging machine 3.

Figure 6:
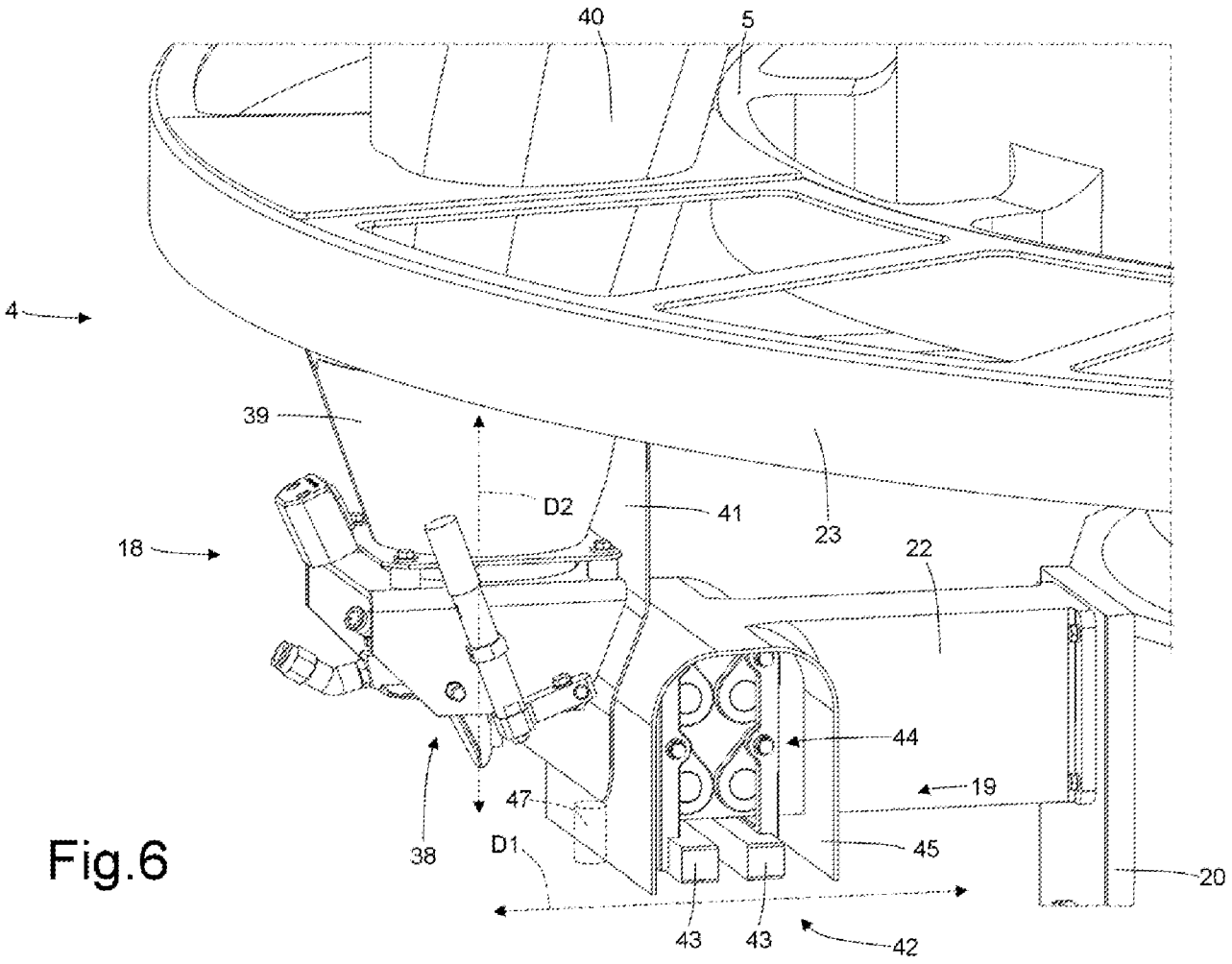
FIG. 6 is a perspective view, on an enlarged scale, of a filling device and of a sealing device of the packaging machine of FIG. 2.
Figure 7:
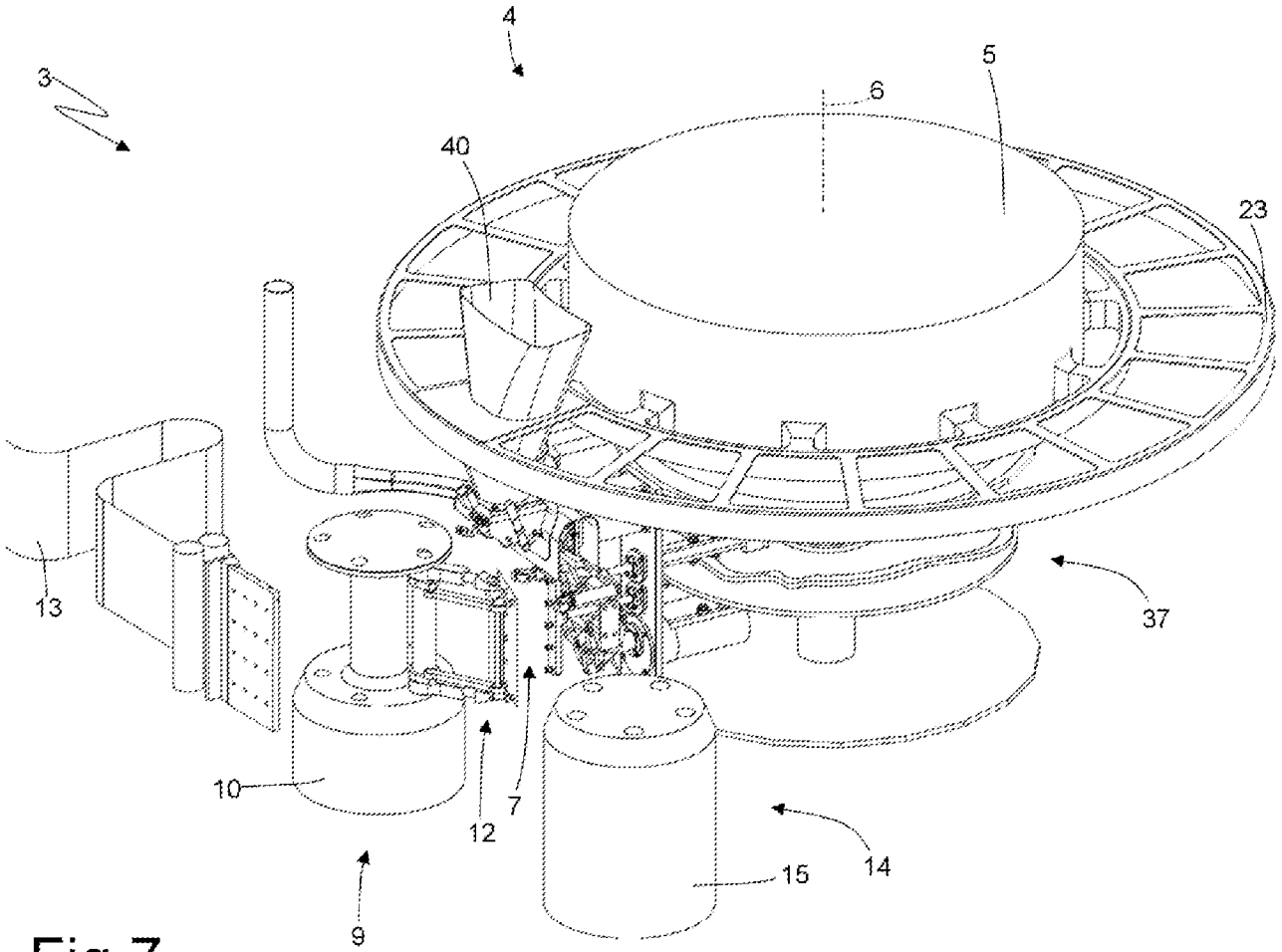
FIGS. 7-11 are a series of perspective views, with further parts removed for clarity, of the packaging machine of FIG. 2.
Figure 8:
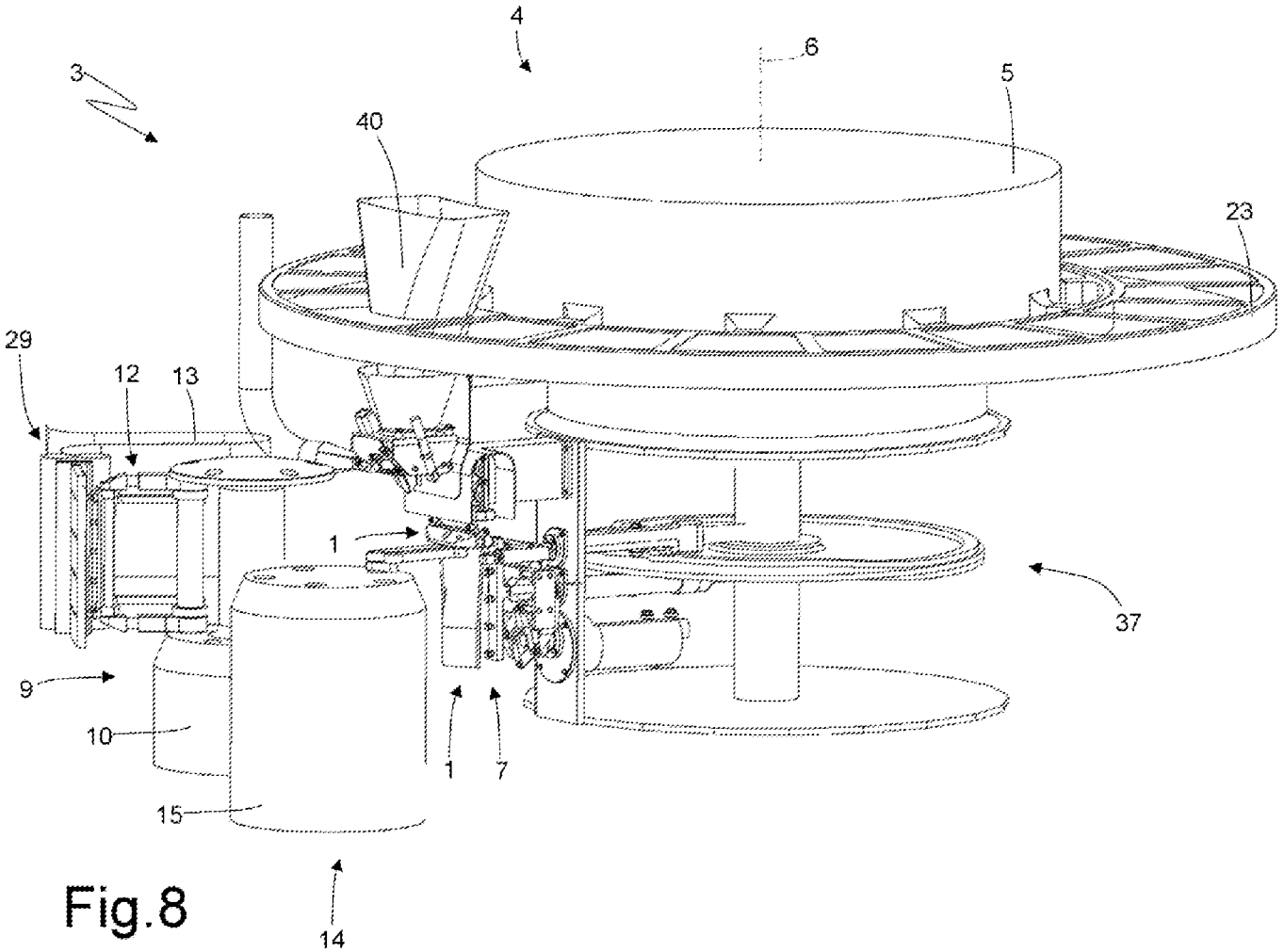
Figure 9:
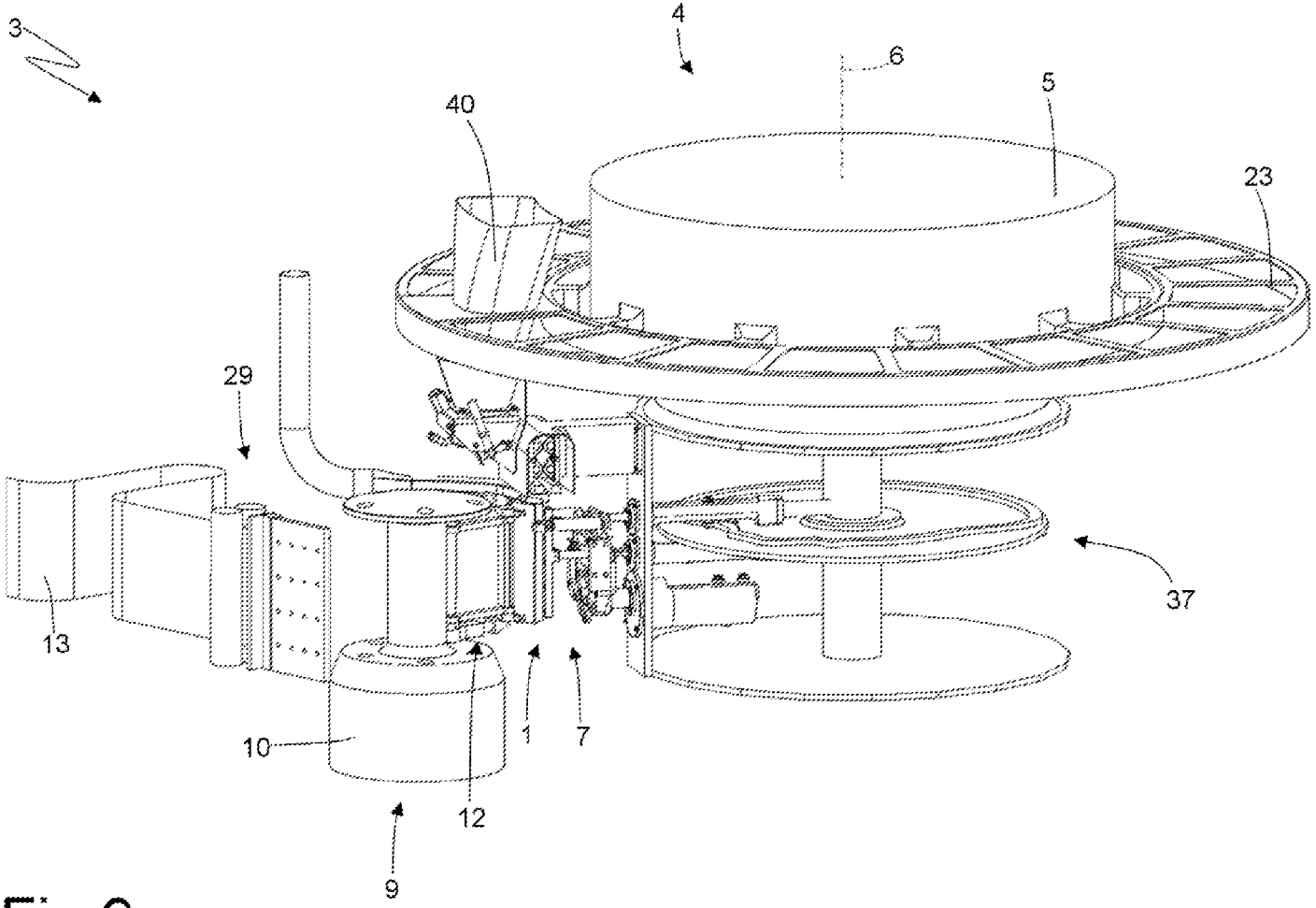

As shown more clearly in FIG. 6, the packaging machine 3 includes many filling devices 18 (only one of which is shown in FIG. 6), each of which is supported by the drum 5 of the packaging conveyor 4 (so it is mounted movable along the packaging path P1), is coupled to a corresponding pick-up head 7, and is designed to feed from above and through the upper open end 2 the dose of the product into a bag 1 carried by the same corresponding pick-up head 7. Moreover, the packaging machine 3 includes many sealing devices 19 (only one of which is shown in FIG. 6), each of which is supported by the drum 5 of the packaging conveyor 4 (so it is mounted movable along the packaging path P1), is coupled to a corresponding pick-up head 7 and is designed to seal a full bag 1 carried by the corresponding pick-up head 7 through a sealing at the upper end 2. So, to each pick-up head 7, a corresponding filling device 18 and a corresponding sealing device 19 are coupled, which are both mounted on the packaging conveyor 4, to move together with the pick-up head 7 along the entire packaging path P1.

It is important to note that for each pick-up head 7, the sealing device 19 is near but in any case separate from the filling device 18 in such a way that the sealing is performed in a "clean" area, that is as far as possible free of product residues that can damage the execution of the sealing if they "dirty" the sealing area.

For each pick-up head 7, the corresponding filling device 18 and the corresponding sealing device 19 are arranged on the packaging conveyor 4 one beside the other and at a certain distance (that is at a determined distance) from each other along a direction D1 of horizontal selection (i.e. one that lies on a horizontal plane), arranged radially (perpendicularly) with respect to the rotation axis 6 and so transversely (perpendicularly) to the packaging path P1. Each pick-up head 7 is mounted movably on the packaging conveyor 4 for translating along the selection direction D1 between a filling position F (shown in FIG. 4) in which the pick-up head 7 is aligned with the filling device 18 filler and a sealing position S (shown in FIG. 4) in which the pick-up head 7 is aligned with the sealing device 19; in other words, by translating along the selection direction D1 of the pick-up head 7 it "selects" the filling position F or the sealing position S.

Figure 5:
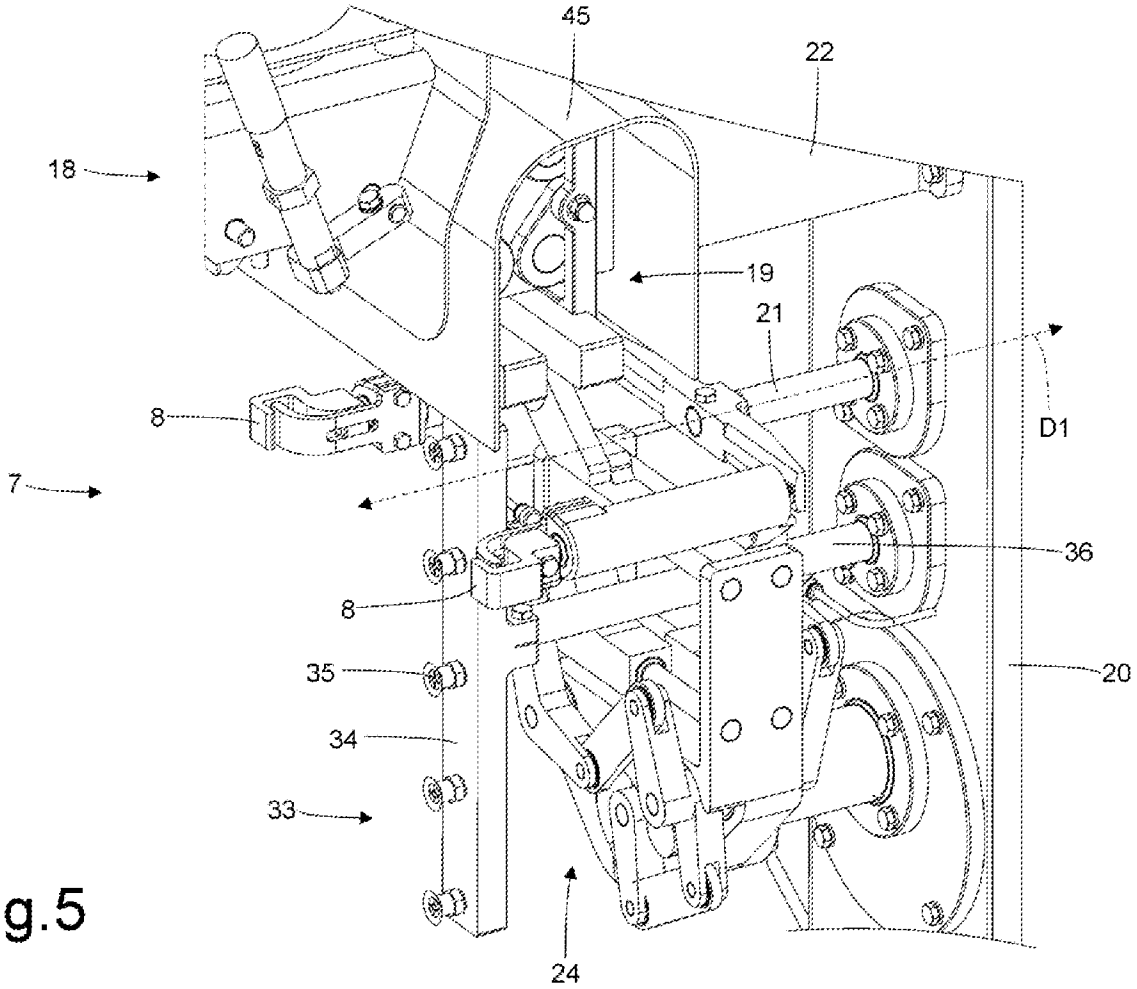
FIG. 5 is a perspective view and on an enlarged scale of a pick-up head of the packaging machine of FIG. 2.

As shown more clearly in FIG. 5, the packaging conveyor 4 includes many supporting plates 20 of rectangular shape (only one of which is illustrated in FIG. 5), each of which is rigidly mounted on the drum 5 of the packaging conveyor 4, is arranged vertically (so parallel to the rotation axis 6) and supports a corresponding pick-up head 7. In particular, for each pick-up head 7 a shaft 21 is provided, which is supported in a sliding manner by the supporting plate 20 to slide along the selection direction D1, and carries the same pick-up head 7. Consequently, each pick-up head 7 is mounted in a fixed angular position on the drum 5 of packaging conveyor 5 in order to avoid its inclination to vary with respect to the drum 5 itself.

Each supporting plate 20 also carries the corresponding sealing device 19 through a rigid bracket 22 which is bolted to the supporting plate 20 (that is, it is rigidly connected to the supporting plate 20); consequently, each sealing device 19 is mounted in a fixed position on the drum 5 of the packaging conveyor 4, that is, each sealing device 19 rotates together with the drum 5 and does not make any relative movement with respect to the drum 5 itself.

As shown more clearly in FIG. 6, the drum 5 of the packaging conveyor 4 includes a perforated ring 23 which is arranged around the drum 5 and supports the filling devices 18; the ring 23 which carries the filling devices 18 is arranged above the supporting plates 20 that carry the pick-up heads 7 and so each filling device 18 is arranged above the corresponding pick-up head 7 to feed the product from above into the bags 1 carried by the pick-up heads 7. The ring 23 is rigidly bound to the drum 5 of the packaging conveyor 4 and so the filling devices 18 are angularly built into the drum 5 of the packaging conveyor 4.

Each filling device 18 is mounted movably on the ring 23 (so on the drum 5 of the packaging conveyor 4) for translating between a rest position (more above and shown in FIGS. 6-9 and 11) and a working position (more below and shown in FIG. 10) along a vertical working direction D2 that is parallel to the rotation axis 6 and is perpendicular to both the selection direction D1 and the packaging path P1. Each filling device 18 is normally maintained in the rest position and is arranged in the working position only during the filling of a bag 1 carried by the corresponding pick-up head 7.

As shown in FIG. 5, in each pick-up head 7 the two clamps 8 are movable to move closer to and away from each other under the control of a substantially known type of actuator device 24 (e.g. as described in the patent application EP2853497A1) which is driven through fixed cams (partly visible in FIGS. 7-11) and is arranged inside the drum 5 of the packaging conveyor 4. The movement that each actuator device 24 gives to the two clamps 8 is adjustable by varying the axial position of the fixed cams in order to adapt the movement itself to the format (that is, to the real size) the two clamps 8 of each pick-up head 7 are mutually disposed at a greater distance in correspondence with the input station S1 when the corresponding bag 1 is empty and in a flattened configuration (that is, with the opposite edges of the open upper end 2 in close mutual contact) and get closer based on when the empty bag 1 passes from the flattened configuration to an open configuration (or as the opposite edges of the open upper end 2 are moved apart), thus following the deformation of the bag 1 that is necessary in order to open the bag 1 itself; in fact, for obvious geometric constraints (the bags 1 are flexible but not deformable) a bag 1 can pass from the flattened configuration to the open configuration (that is, the opposite edges of the open upper end 2 can be moved apart) only if the two sides of the bag 1 (tight by the two clamps 8 of the corresponding pick-up head 7) get closer.

Figure 13:
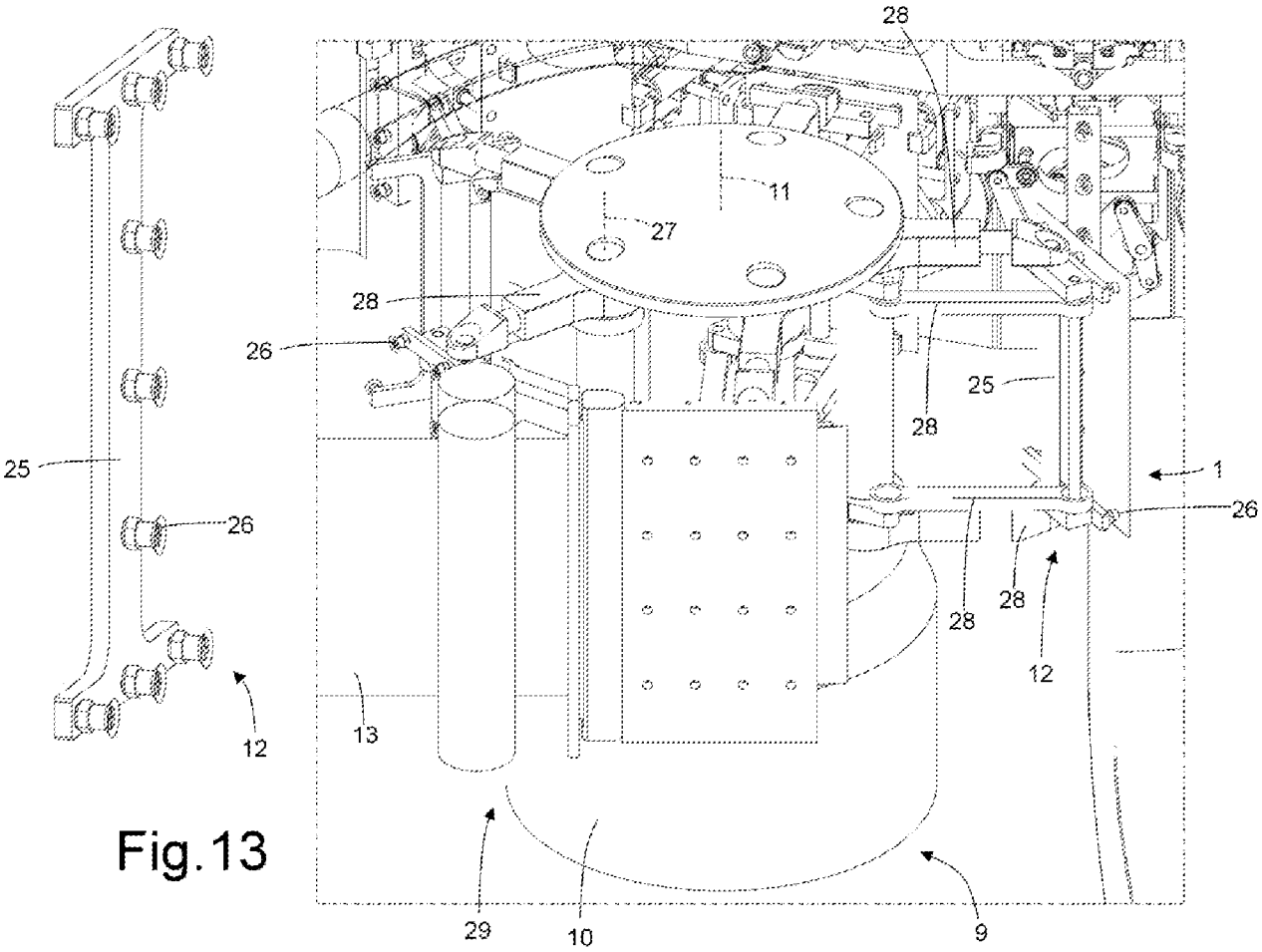
FIG. 13 is a perspective view, on an enlarged scale, of a supplying conveyor of the packaging machine of FIG. 2.

As shown in FIGS. 3 and 13, each supplying head 12 includes a "I" shaped rigid body 25 that carries many suction cups 26 which are designed to retain for aspiration an empty and flattened bag 1; it is important to note that each supplying head 12 (i.e. the rigid body 25 of the supplying head 12) is adapted to engage an empty and flattened bag 1 at different points with respect to the points engaged by the two clamps 8 of a pick-up head 7 in such a way that a bag 1 in the input station S1 can be at the same time engaged by a supplying head 12 and a pick-up head 7. Each supplying head 12 is mounted rotating on the drum 10 of the supplying conveyor 9 to rotate with respect to the drum 10 itself around a rotation axis 27 parallel to the rotation axis 11 due to the action of a cams actuation system; when used, each supplying head 12 rotates with respect to the drum 10 in the opposite direction with respect to the rotation direction of the drum 10 itself when it is located in the input station S1 to stay for a certain time facing and parallel to a corresponding pick-up head 7 of the packaging conveyor 4, and so allow an easy transfer of an empty bag 1 from the supplying head 12 to the pick-up head 7. According to a preferred, but not binding, embodiment shown in the annexed figures, each supplying head 12 is connected to the drum 10 of the supplying conveyor 9 by means of a pair of upper arms 28 and a pair of lower arms 28 (identical to the upper arms 28, not shown in FIG. 3): each arm 28 is hinged to an end to the drum 10 of the supplying conveyor 9 and is hinged at the opposite end to the supplying head 12 in such a way that a pair of arms 28 forms with the supplying head 12 and with the drum 10 an articulated quadrilateral.

In the cutting station S3 a cutting device 29 is provided, which separates in succession each bag 1 from the continuous belt 13 of preformed bags 1 and provides the bag 1 to a corresponding supplying head 12 of the supplying conveyor 9.

Figure 12:
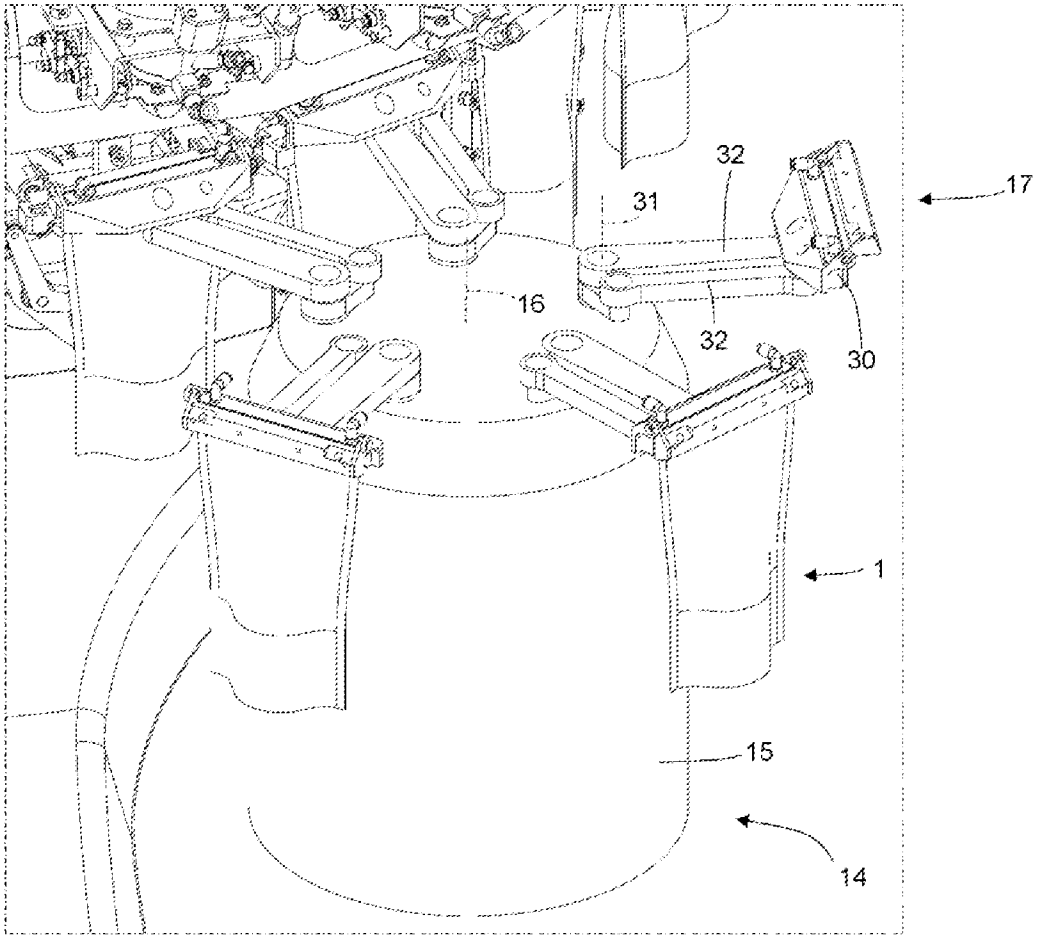
FIG. 12 is a perspective view, on an enlarged scale, of a stabilization conveyor of the packaging machine of FIG. 2.

As shown in FIGS. 3 and 12, each stabilization head 17 includes a single clamp 30 which is oriented perpendicularly to the clamps 8 of the pick-up heads 7 and is designed to grab a respective bag 1 filled and sealed in correspondence to the upper end 2; in this way, each clamp 30 squeezes the upper end 2 of the bag 1 in correspondence with the just-executed heat-seal, allowing the heat-seal to cool without the possibility of unwanted detachments of the just-sealed material. Consequently, the stabilization conveyor 14 allows the just performed heat-seal to stabilize without any danger of unwanted detachments of the just-sealed material. It is important to note that each stabilization head 17 (i.e. the clamp 30 of the stabilizing head 17) is adapted to engage a full and sealed bag at different points other than the points engaged by the two clamps 8 of a pick-up head 7 in such a way that a bag in the output station S2 can be engaged at the same time by a stabilization head 17 and by a pick-up head 7. Each stabilization head 17 is mounted rotating on the drum 15 of the stabilization conveyor 14 to rotate with respect to the drum 15 itself around a rotation axis 31 parallel to the rotation axis 16 due to the action of a cams actuation system; when used, each stabilizing head 17 rotates with respect to the drum 15 in the opposite direction with respect to the rotation direction of the drum 15 itself, when it is in the output station S2 to remain for a certain time facing and parallel to a corresponding pick-up head 7 of the packaging conveyor 4, and so allow an easy transfer of an empty bag 1 from the pick-up head 7 to the stabilization head 17. According to a preferred, but not binding, embodiment shown in the annexed figures, each stabilization head 17 is connected to the drum 15 of the stabilization conveyor 14 through a pair of arms 32: each arm 32 is hinged to one end to the drum 15 of the stabilization conveyor 14 and is hinged to the opposite end to the stabilization head 17 in such a way that the pair of arms 32 forms with the stabilization head 17 and with the drum 15 an articulated quadrilateral.

As better shown in FIG. 5, each pick-up head 7 is coupled to a corresponding opening device 33, which is carried by the corresponding supporting plate 20 and acts in the input station S1 to open a corresponding bag 1 moving away from each other the two opposite edges of the upper end 2 of the bag 1 itself (as previously mentioned, the deformation of the bag 1 in order to separate the two opposite edges of the upper end 2 is accompanied by a progressive mutual approach of the two clamps of the pick-up head 7. Each opening device 33 includes a body 34 which is provided with a series of suction cups 35, is arranged between the two clamps 8 of the pick-up head 7 and is mounted movable on the supporting plate 20 to translate along the selection direction D1 as an effect of a cams actuation system. According to an alternative and perfectly equivalent embodiment, the body 34 moves along the selection direction D1 due to the action of a dedicated electric motor; this solution allows a greater flexibility of the law of motion of the body 34, since the same law of motion can be modified via software (by simplifying the format change operations and enabling a better optimization of the opening operation of the bags 1).

In particular, for each opening device 33 a shaft 36 is provided, which is supported in a sliding way by the supporting plate 20 to slide along the selection direction D1, and carries the opening device 33 itself; the sliding of the shaft 36 (that is, of the opening device 33) along the selection direction D1 is controlled by a cams actuation system. When used, when a pick-up head 7 is located in the input station S1 and receives an empty and flattened bag 1 the corresponding opening device 33 is disposed in a radially extracted position (that is, it is arranged towards the outside) in such a way that its suction cups 35 engage (retaining by suction) a surface of the bag 1 whereas the other opposite surface of the bag 1 is still committed (retained by suction) by the suction cups 26 of the corresponding supplying head 12; thus, the opening device 33 is moved along the selection direction D1 towards a radially retracted position (that is, inwardly) to move the surface of the bag 1 retained by the opening device 33 away from the other opposite surface of the bag retained by the corresponding supplying head 12 causing the opening of the bag 1 (i.e. by separating the opposite edges of the upper end 2). As previously said, the opening of the bag 1 is accompanied by a mutual approach of the two clamps 8 of the pick-up head 7 that is necessary to allow the bag 1 to deform in order to allow the two opposite edges of the upper end 2 to move away from each other.

According to a possible embodiment, each opening device 33 also includes one or more nozzles which are arranged above the corresponding pick-up head 7 (that is, above the corresponding bag 1) and are designed to direct the jets of compressed air directed vertically towards the upper end 2 of the bag to facilitate the mutual separation of the two edges opposite to the upper end 2 itself.

Figure 4:
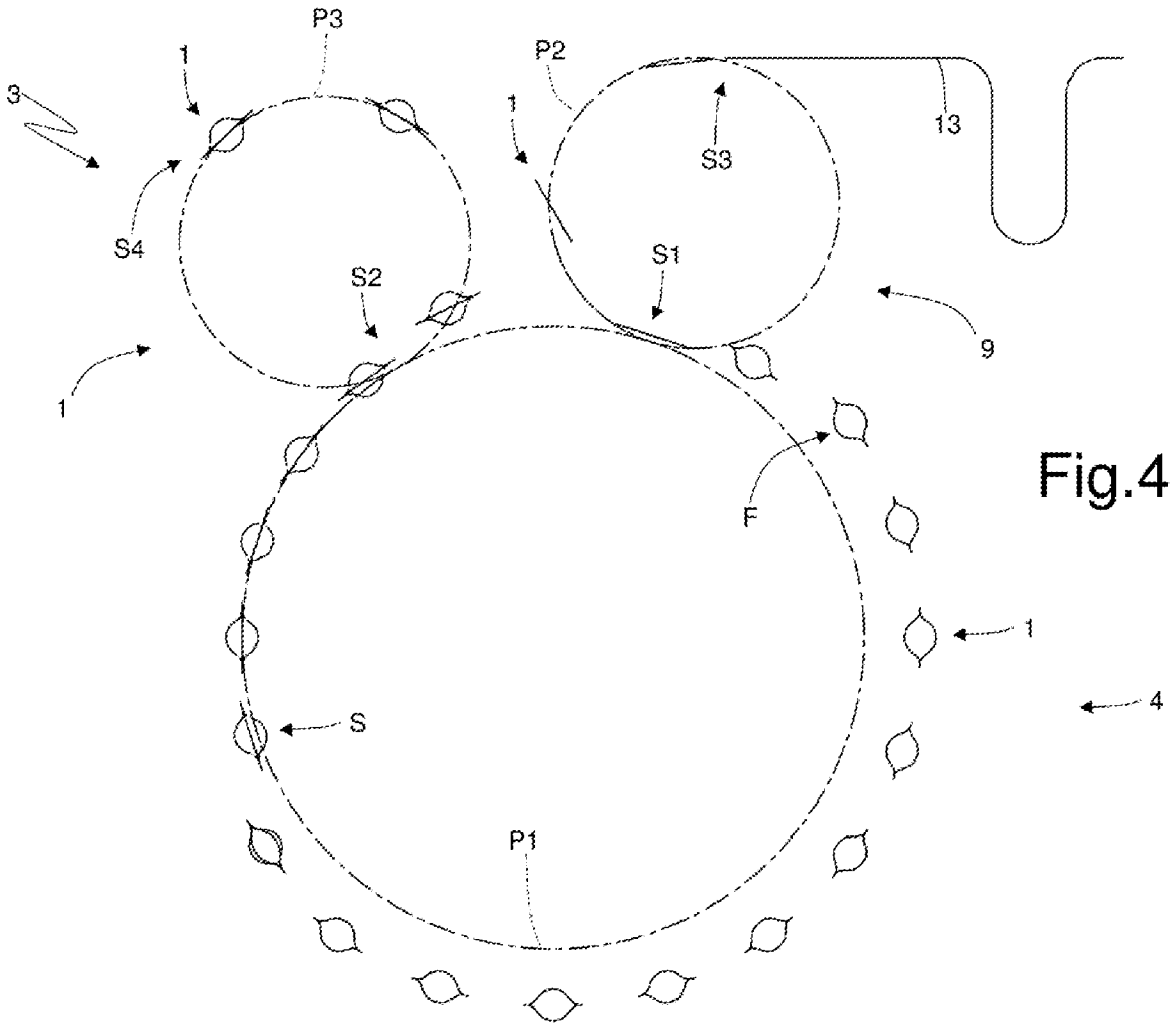
FIG. 4 is a schematic and plan view of the packaging machine of FIG. 2.

As shown in FIG. 4, the packaging machine 3 includes a cam actuating device 37 (partially shown in FIGS. 7-11) that moves each pick-up head 7 along the selection direction D1, put in the input station S1 the pick-up head 7 in the sealing position S, downstream of the input station S1 it moves the pick-up head 7 outwards to place the pick-up head 7 in the filling position F to perform the filling of the bag 1, and then it moves the pick-up head 7 inwards in order to put the pick-up head 7 again in the sealing position S (which is maintained until the output station S2) to perform the heat-sealing of the open upper end 2 of the bag 1.

Figure 10:
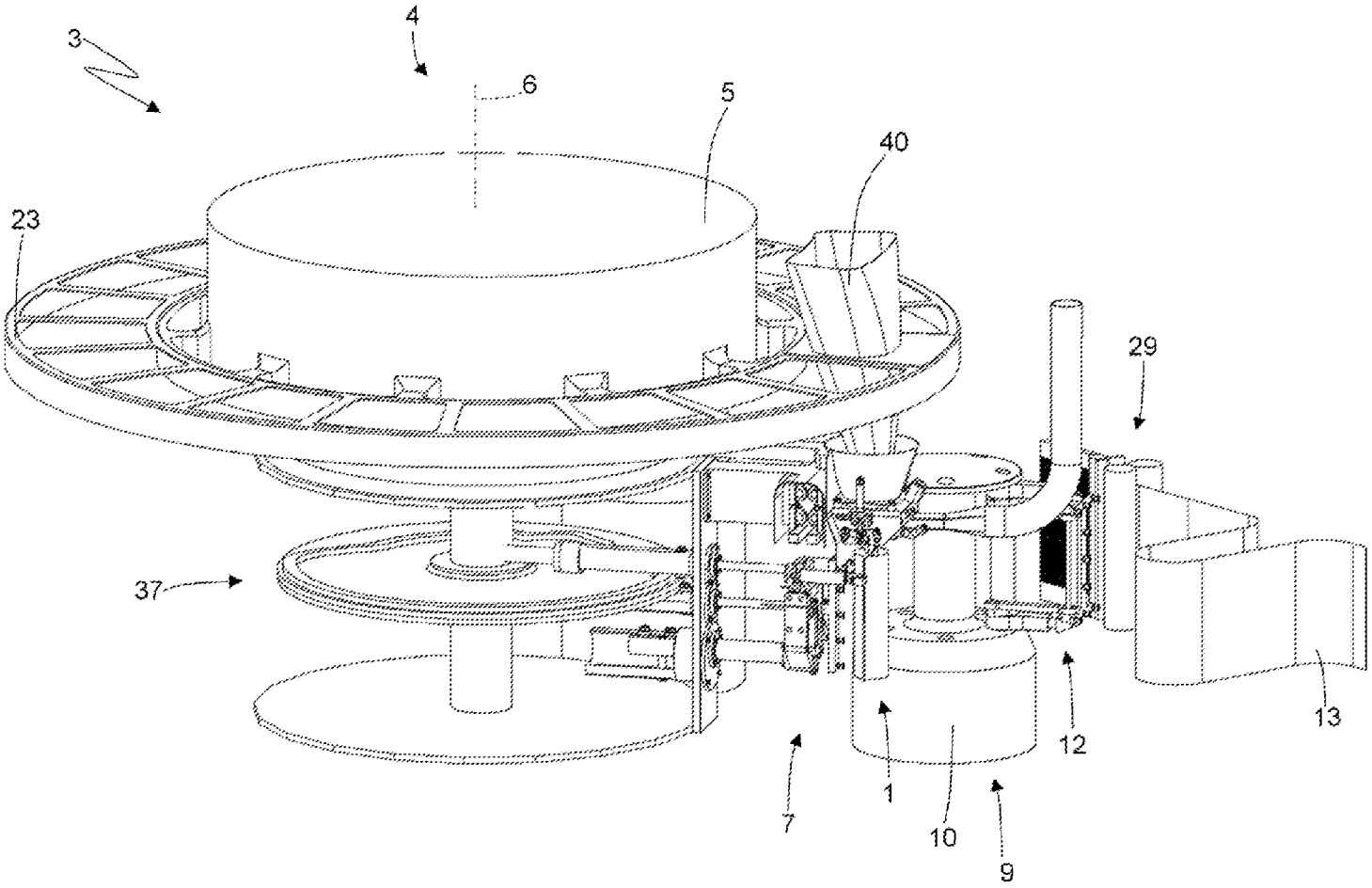
Figure 11:
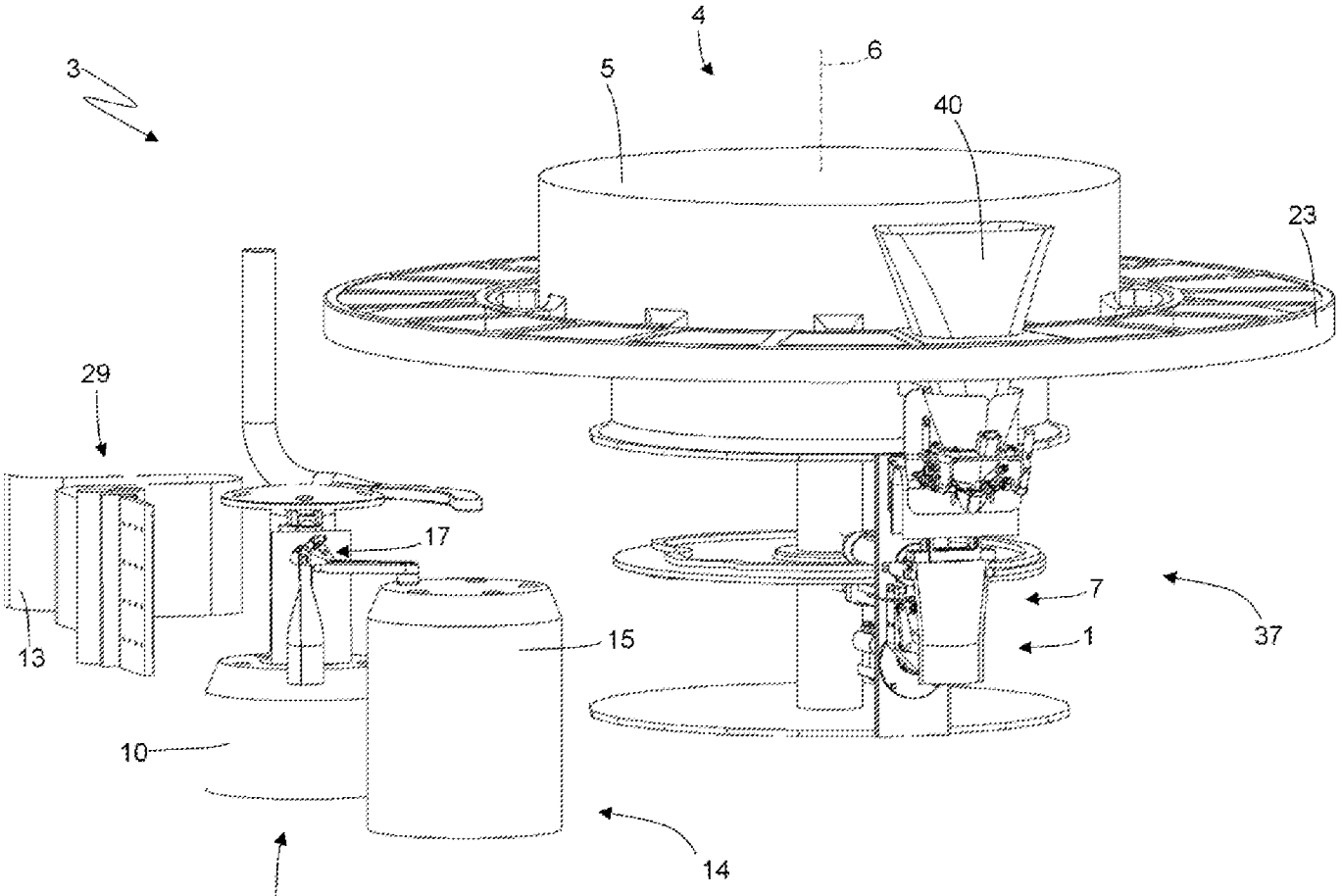

As shown in FIG. 6, each filling device 18 includes an opening 38 which is arranged below (i.e. towards the corresponding pick-up head 7) and through which the product that fills the bags 1 comes out; the opening 38 receives the product from a mobile hopper 39 that moves together with the opening 38 along the vertical working direction D2 between the rest position (above and shown in FIGS. 6-9 and 11) and the working position (down and shown in FIG. 10). The mobile hopper 39 is coupled to a fixed hopper 40 which is disposed above the movable hopper 39 and is rigidly mounted on the ring 23; essentially, the two hoppers 39 and 40 interpenetrate each other and together form a telescopic system that follows the movement along the vertical working direction D2 of the opening 38. As shown in FIG. 6, each filling device 18 includes a screen 41 which is mobile together with the opening 38 along the vertical working direction D2 and is disposed between the filling device 18 and the sealing device 19.

According to a preferred embodiment, each filling device 18 includes at least one nozzle which is arranged in correspondence with the opening 38 and injects into the bag 1 an inert gas (typically nitrogen) at the same time with the feeding of the product to reduce the content of oxygen inside the bag 1 itself.

As shown in FIG. 6, each sealing device 19 includes a sealing clamp 42 that squeezes the bag 1 in correspondence with at the open upper end 2 and is composed of two heated jaws 43 (typically through respective resistance thermometers embedded in the jaws 43) and of a handling mechanism 44 which is driven by the cams and moves the sealing clamp 42 between a rest position (shown in FIGS. 6-10) in which the sealing clamp 42 is relatively far away from the bag 1 carried by the corresponding pick-up head 7 and a working position (shown in FIG. 11) in which the sealing clamp 42 engages (squeeze) the upper end 2 of the bag 1 carried by the corresponding pick-up head 7. Essentially, each handling mechanism 44 gives to the sealing clamp 42 a vertical movement (through which the sealing clamp 42 closes or opens the bag 1), and a horizontal movement (through which the sealing clamp 42 closes or opens in order to move away from the bag 1). According to a preferred embodiment shown in FIG. 6, each sealing device 19 includes a screen 45 which is rigidly connected to the rigid bracket 22 and is adapted to a "U" shape.

According to a different embodiment not shown, when the bags 1 are provided with a central screwed-on cap each sealing device 19 includes, in addition to the sealing clamp 42, that performs a transverse heat-seal in correspondence of the upper end 2 of each bag 1, also a further sealing clamp that performs a transverse heat-seal in correspondence of the cap; when used, the two sealing clamps of the sealing device 19 operate in succession (that is, first one and then the other) to perform the two transverse heat-seals which are mutually parallel and spaced apart.

According to a preferred embodiment shown in FIG. 2, a scrap chute 46 is provided, which is arranged in correspondence of the output station S2 below the packaging conveyor 4 and in designed to receive and convey by gravity a defective bag 1 that in the output station S2 is released from the corresponding pick-up head 7. In other words, when a bag 1 is identified as defective (i.e. it is identified as to be discarded), in the output station S2, the bag 1 itself is not grabbed by a stabilization head 17 of the stabilization conveyor 14 and then when in the output station S2 is released from the corresponding pick-up head 7 of the packaging conveyor 4 it falls by gravity down landing on the underlying scrap chute 46 that ends in a container of discarded (defective) bags 1.

According to a preferred embodiment shown schematically in FIG. 6, each pick-up head 7 is provided with a micro-wave control device 47 which is mounted on the filling device 18 or on the sealing device 19 and is designed to detect the presence of product in correspondence of the open upper end 2 of the bag 1 where the heat-sealing must be performed: a bag 1 is identified as defective if the corresponding microwave control device 47 detects the presence (beyond a certain threshold) of the product in correspondence with the open upper end 2 of the bag 1, where the heat-sealing must be performed (in fact a significant presence of product in correspondence of the area that must be sealed negatively interferes with the sealing process, preventing the obtaining of a good quality heat-seal and therefore it inevitably makes the bag 1 defective).

What follows is a description of the functioning of the packaging machine 3 described above with reference to the packaging of a single bag 1 and with reference to what is shown in FIG. 4.

Initially, the empty and flattened bag 1 (i.e. with the opposite edges of the upper end 2 in close mutual contact) is an integral part of the continuous belt 13 of the preformed bags 1, from which it is separated by a transversal cut by the cutting device 29 arranged in the cutting station S3; immediately after it has been separated from the continuous belt 13 of the preformed bags 1, the empty and flattened bag 1 is engaged by a supplying head 12 of the supplying conveyor 9. Subsequently, the supplying conveyor 9 moves the supplying head 12 that carries the empty and flattened bag 1 towards the input station S1 in which the empty and flattened bag 1 is transferred from the supplying head 12 of the supplying conveyor 9 to a pick-up head 7 of the packaging conveyor 4.

In the input station S1, the empty and flattened bag 1 is engaged at the same time by the supplying head 12 of the supplying conveyor 9 (whose suction cups 26 are annexed to a surface of the empty and flattened bag 1), from the two clamps 8 of the pick-up head 7, and also from the opening device 33 (whose suction cups 35 are annexed to a surface of the empty and flattened bag 1 opposite to the surface engaged by the supplying head 12); starting from this situation, the opening device 33 moves away from the supplying head 12 by sliding (radially) along the selection direction D1 to separate the two opposite edges of the upper end 2 and thus determine the opening of the empty bag 1 (as previously mentioned, the opening of the empty bag 1 is followed by a reciprocal approaching movement of the two clamps 8 of the pick-up head 7). Once completed the opening of the empty bag 1, the supplying head 12 of the supplying conveyor 9 and the opening device 33 detach from the empty and open bag 1 leaving the bag 1 empty and open to the clamps 8 of the pick-up head 7.

In the input station S1, the pick-up head 7, while it receives the empty and flattened bag 1 from the supplying head 12 of the supplying conveyor 9 is located in the sealing position S.

While the packaging conveyor 4 advances the empty and open bag 1 carried by the pick-up head 7 along the packaging path P1, the pick-up head 7 slides radially along the selection direction D1 to move the empty and open bag 1 in the filling position F (i.e. below the filling device 18); so, the filling device 18 moves downward along the working direction D2 (from the rest position to the working position) to insert the opening 38 itself into the open upper end 2, and so perform the insertion of the dose of the product into the empty and open bag 1. At the end of the filling of the bag 1, the filling device 18 moves upwards along the working direction D2 (from the working position to the rest position) to release the full and open bag 1; therefore, the pick-up head 7 slides radially along the selection direction D1 to move the full and open bag 1 to the sealing position S (i.e. below the sealing device 19), always while the packaging conveyor 4 moves the full and open bag 1 carried from the pick-up head 7 along the packing path P1.

At this point, the sealing device 19 moves from the rest position to the working position (in which the sealing clamp 42 engages the upper end 2 of the bag 1 carried from the pick-up head 7) for executing the heat-sealing of the upper end 2, always while the packaging conveyor 4 advances the bag 1 carried from the pick-up head 7 along the packaging path P1. At the end of the heat-sealing of the bag 1, the sealing device 19 moves from the working position to the rest position and when the pick-up head 7 carrying the full and sealed bag 1 arrives in the output station S2 the full and sealed bag 1 is transferred from the pick-up head 7 of the packaging conveyor 4 to a stabilization head 17 of the of the stabilization conveyor 14. As previously said, if the full and sealed bag 1 has been identified as defective, then in the output station S2 the stabilization head does not close to grab the full and sealed bag 1, and so the full and sealed bag 1 itself falls by gravity towards the scrap chute 46.

The packaging machine 3 described above presents several advantages.

Firstly, the packaging machine 3 described above can improve the overall quality of the bags 1 thanks to a reduction in external contamination; this result is obtained thanks to the fact that the heat-sealing of the open upper end 2 of each bag 1 occurs immediately after the filling of the bag 1 itself (for each pick-up head 7 the sealing device 19 is arranged very close to the filling device 18: the mutual distance is of a maximum of 15-25 cm) and so the time for which the bag 1 remains full and open is extremely reduced (in this time period the inert gas contained in the bag 1 can partially flow out and be replaced by other not controlled gases present in the atmosphere). In this way it is also possible to significantly reduce the consumption of inert gas, as it is not necessary to overdose the inert gas to compensate for high losses of inert gas between the filling and the heat-sealing. Moreover, all parts subject to high wear (seals and other rubber parts or similar) are far from the pick-up heads 7 (i.e. from the bags 1 and from the dosed product into the bags 1) eliminating the risk of possible contamination of the product and/or the bags 1 with rubber particles or similar.

The packaging machine 3 described above can improve the overall quality of the bags 1 also thanks to a better precision in the execution of the processing; this result is obtained thanks to the fact that in every moment of the processing the position of each bag 1 is ensured in an extremely precise and reliable way.

The packaging machine 3 described above can reduce the percentage of waste (i.e. of defective bags 1); this result is obtained thanks to the fact that during the whole processing the position of the bags 1 is always ensured in a very precise way also thanks to the use of a packaging conveyor 4 provided with a single drum 5 mounted rotating that directly supports the pick-up heads 7 (compared to a chain conveyor which is wound around guide pulleys, the control of the position of the pick-up heads 7 is improved).

The packaging machine 3 described above can reduce the space taken up and improve the accessibility for the execution of cleaning, maintenance and size change services (i.e. all the parts of the packaging machine 3 described above are easily accessible by an operator); these results are obtained thanks to the fact that the use of a packaging conveyor 4 provided with a single drum 5 mounted rotating that directly supports the pick-up heads 7 allows to considerably reduce the overall size of the packaging machine 3.

The packaging machine 3 described above requires reduced maintenance; this result is obtained thanks to the fact of using a packaging conveyor 4 provided with a single drum 5 mounted rotating entirely without any chain (the chains which continuously deform have a high level of wear that requires frequent maintenance).

Finally, the packaging machine 3 described above is of relatively simple and economical fabrication.

The invention claimed is:

1. An automatic packaging machine (3) for filling a bag (1) made of a heat-sealable material and having an open upper end (2) with a dose of a loose product; the packaging machine (3) comprises:

a packaging conveyor (4);

a pick-up head (7), which is supported by the packaging conveyor (4) so as to be fed along a packaging path (P1) lying on a horizontal plane, is designed to grab and hold the bag (1) along the packaging path (P1), and comprises a pair of first clamps (8), which are opposite one another and are designed to grab opposite side ends of the corresponding bag (1);

an input station (S1), which is arranged at the beginning of the packaging path (P1) and where the empty bag (1) is grabbed by the pick-up head (7);

an output station (S2), which is arranged at the end of the packaging path (P1) and where the full, sealed bag (1) leaves the pick-up head (7);

a filling device (18), which is movable along the packaging path (P1) and is designed to feed the product dose into the bag (1) through the open upper end (2); and a sealing device (19), which is movable along the packaging path (P1) and is designed to seal the full bag (1) through a sealing in the area of the open upper end (2);

wherein the filling device (18) and the sealing device (19) are both mounted on the packaging conveyor (4) so as to move together with the pick-up head (7) along the entire packaging path (P1);

the filling device (18) and the sealing device (19) are arranged on the packaging conveyor (4) next to one another along a selection direction (D1), which is transverse to the packaging path (P1) and lies in a horizontal plane; and the pick-up head (7) is movable on the packaging conveyor (4) so as to translate, along the selection direction (D1), between a filling position (F), in which the pick-up head (7) is aligned with the filling device (18), and a sealing position (S), in which the pick-up head (7) is aligned with the sealing device (19).

2. A packaging machine (3) according to claim 1, wherein:

the packaging conveyor (4) comprises a first drum (5), which is mounted so as to rotate around a first rotation axis (6) and supports the pick-up head (7), the filling device (18) and the sealing device (19);

the packaging path (P1) has a circular shape; and the selection direction (D1) is oriented radially, namely perpendicularly to the first rotation axis (6).

3. A packaging machine according to claim 2, wherein the pick-up head (7) is mounted in an angularly fixed position on the first drum (5), so as to never vary its inclination relative to the first drum (5).

4. A packaging machine (3) according to claim 1 and comprising an opening device (33), which is arranged in the input station (S1), opens the bag (1) by moving apart the two opposite edges of the upper end (2) of the bag (1), comprises at least one first suction cup (36) engaging a first surface of the bag (1), and is movable along the selection direction (D1).

5. A packaging machine (3) according to claim 4, wherein the two first clamps (8) of the pick-up head (7) are movable so as to be moved closer to and away from one another, thus following the deformation of the bag (1) when the bag (1) is opened.

6. A packaging machine (3) according to claim 4, wherein the first suction cup (36) of the opening device (33) is supported by the packaging conveyor (4) and is movable on the packaging conveyor (4) so as to move along the selection direction (D1) independently of the pick-up head (7).

7. A packaging machine (3) according to claim 4 and comprising:

a supplying conveyor (9); and a supplying head (12), which is supported by the supplying conveyor (9) so as to be fed along a supplying path (P2) ending in the area of the input station (S1), where the bag (1) is transferred from the supplying head (12) of the supplying conveyor (9) to the pick-up head (7) of the packaging conveyor (4), is designed to receive and hold the bag (1) along the supplying path (P2), and comprises at least one second suction cup (26), which engages a second surface of the bag (1) opposite the first surface.

8. A packaging machine (3) according to claim 7, wherein:

the supplying conveyor (9) comprises a second drum (10), which is mounted so as to rotate around a second rotation axis (11) and supports the supplying head (12); and the supplying path (P2) has a circular shape.

9. A packaging machine (3) according to claim 8, wherein the supplying head (12) is rotary on the second drum (10) so as to rotate relative to the second rum (10) around a third rotation axis (27), which is parallel to the second rotation axis (11).

10. A packaging machine (3) according to claim 7 and comprising a cutting device (29), which separates the bag (1) from a continuous strip (13) of preformed bags (1) and delivers the bag (1) to the supplying head (12) of the supplying conveyor (9).

11. A packaging machine (3) according to claim 1 and comprising a cam operating device (37), which moves the pick-up head (7) along the selection direction (D1), places the pick-up head (7) in the sealing position (S) in the input station (S1), moves the pick-up head (7) outwards so as to place the pick-up head (7) in the filling position (F), and moves the pick-up head (7) inwards so as to place the pick-up head (7), again, in the sealing position (S), which is maintained until the output station (S2).

12. A packaging machine (3) according to claim 1 and comprising a stabilization conveyor (14); and a stabilization head (17), which is supported by the stabilization conveyor (14) so as to be fed along a stabilization path (P3) beginning in the area of the output station (S2), where the bag (1) is transferred from the pick-up head (7) of the packaging conveyor (4) to the stabilization head (17) of the stabilization conveyor (14), and is designed to receive and hold the bag (1) along the stabilization path (P3).

13. A packaging machine (3) according to claim 12, wherein:

the stabilization conveyor (14) comprises a third drum (15), which is mounted so as to rotate around a fourth rotation axis (16) and supports the stabilization head (17); and the stabilization path (P3) has a circular shape.

14. A packaging machine (3) according to claim 13, wherein the stabilization head (17) is rotary on the third drum (15) so as to rotate relative to the third rum (15) around a fifth rotation axis (31), which is parallel to the fourth rotation axis (16).

15. A packaging machine (3) according to claim 12, wherein the stabilization head (17) comprises a second clamp (30), which is oriented perpendicularly to the first clamps (8) of the pick-up head (7) and is designed to grab an upper end (2) of the bag (1) in the area of the open upper end (2).

16. A packaging machine (3) according to claim 1, wherein the filling device (18) is movable on the first drum (5) so as to translate between a rest position and an operating position along a vertical operating direction (D2), which is perpendicular to the selection direction (D1) and to the packaging path (P1).

17. A packaging machine (3) according to claim 1, wherein the sealing device (19) is mounted on the first drum (5) in a fixed position.

18. A packaging machine (3) according to claim 1 and comprising a waste chute (46), which is arranged in the area of the output station (S2) under the packaging conveyor (4) and is designed to receive and convey, due to gravity, a defective bag (1) that, in the output station (S2), is released by the pick-up head (7).

19. A packaging machine (3) according to claim 1 and comprising a microwave control device (47), which is mounted on the filling device (18) or on the sealing device (19) and is designed to detect the presence of a product in the area of the open upper end (2) of the bag (1) where the sealing is to be carried out.

20. A packaging machine (3) according to claim 19, wherein the bag (1) is identified as defective if the microwave control device (47) detects the presence of a product in the area of the open upper end (2) of the bag (1) where the sealing is to be carried out.

21. A packaging machine (3) according to claim 1, wherein the sealing device (19) comprises a sealing clamp (42), which clamps the bag (1) in the area of the open upper end (2).

22. A packaging machine (3) according to claim 1, wherein the filling device (18) comprises at least one nozzle, which injects an inert gas into the bag (1) at the same time with the feeding of the product to reduce the content of oxygen inside the bag (1).

* * * * *